US005140111A

United States Patent [19]

Vultaggio et al.

[11] Patent Number: 5,140,111

[45] Date of Patent: Aug. 18, 1992

[54] CAM ACTUATED DOME LIGHT BYPASS SWITCH

[75] Inventors: Anthony Vultaggio, Warren; David A. Coffin, Novi, both of Mich.

[73] Assignee: United Technologies Automotive, Inc., Dearborn, Mich.

[21] Appl. No.: 618,770

[22] Filed: Nov. 27, 1990

[51] Int. Cl.[5] ..... H01H 9/00; H01C 10/30

[52] U.S. Cl. ..... 200/4; 200/6 BB; 338/172

[58] Field of Search ..... 200/4, 17 R, 18, 6 R, 200/6 B, 6 BB; 338/172-176, 198, 200, 215

[56] References Cited

U.S. PATENT DOCUMENTS 4,164,633 8/1979 Sheridan et al. ..... 200/4
4,518,832 5/1985 Geremia ..... 200/4
4,827,241 5/1989 Riser et al. ..... 338/172
4,885,434 12/1989 Vultaggio et al. ..... 200/4

*Primary Examiner*—J. R. Scott

[57] ABSTRACT

A rotary, push-pull switch (20) for use in an automobile is combined with a supplemental switch (52) which opens and closes a dome light bypass circuit. The supplemental switch (52) is mounted internally to the rotary, push-pull switch (20) adjacent to a rotating rheostat (48) disposed on a shaft (36). A projection (88), which is radially disposed on the shaft (36), is used to actuate the supplemental switch (52) by engaging a resilient contact leaf (60) when the shaft (36) is rotated sufficiently. The engagement of the projection (88) and contact arm (60) causes the separation of a contact (62) and terminal (64), opens the dome light bypass circuit, and precludes energizing the dome light.

3 Claims, 5 Drawing Sheets

CAM ACTUATED DOME LIGHT BYPASS SWITCH

TECHNICAL FIELD

This invention relates to automotive electrical switches, and more particularly to a dome light bypass switch on a rotary, push-pull headlight switch.

BACKGROUND ART

Rotary, push-pull switches have received widespread use within the automobile industry. This type of combination switch is typically used to operate the headlights by utilizing the push-pull action of the switch and to control the intensity of the dashboard panel lights by utilizing the rotary action of the switch to operate a rheostat. In addition, attempts have been made to utilize the rotary action to control supplemental electrical circuits, such as a dome light bypass switch (to prevent door switches from energizing the dome light).

The use of these combination switches as headlight switches in automobiles puts several limitations on the design of the switch. The first is a need for compactness due to the confined space in which the headlight switch is located, which is typically on the dashboard to the left of the steering wheel. Second, the headlight switch must be uniform in size and design in order to fit within a wide variety of automobiles. Finally, there is a need for ease of fabrication and for minimal fabrication costs due to the large quantities of headlight switches produced.

The prior art contains several attempts to produce a combination switch with a supplemental switch to control the dome light bypass circuit and which meets the requirements for use as an automotive headlight switch. One such switch utilizes a rotating rheostat with a projection which engages a dome light bypass switch externally mounted on the side of the headlight switch housing. The dome light bypass switch consists of an exposed arm extending longitudinally up the side and parallel to the shaft. This switch is limited in applicability due to increased size, susceptibility to damage due to exposure of the external arm, and sensitivity to tolerance accumulation during fabrication of the switch.

In U.S. Pat. No. 4,885,434, a headlight switch with rotating arms mounted on the shaft and a stationary rheostat is described. A dome light bypass switch is internal to the headlight switch housing and functions by having one of the rotating arms engage a plunger which pushes open the dome light bypass switch. The plunger and dome light bypass switch are disposed on the stationary rheostat. Although this headlight switch solves the problems related to the size of such switches, it is difficult to fabricate due to the use of several leaf-type contacts which require extraordinary care during fabrication in order to prevent damage.

An alternative solution is suggested in U.S. Pat. No. 4,827,241 which utilizes a projection on a driver assembly to engage a dome light bypass switch which is sandwiched in line with the rotating components. As with the previous headlight switch, the dome light bypass switch is internal to the headlight switch housing, which results in a compact switch. In addition, this headlight switch is very forgiving to tolerance accumulation during fabrication. Unfortunately, the rotational components have to be small due to the sandwich arrangement and this leads to an overheating problem which limits the switch to low current applications (less than 5 Amp). The low current limitation makes this switch inadequate for the desired automotive use.

DISCLOSURE OF INVENTION

Objects of the invention include an improved supplemental switch on a rotary, push-pull headlight switch.

Another object is an improved dome light bypass switch on a rotary, push-pull headlight switch.

According to the invention, rotation of a shaft causes a projection, radially disposed on the shaft, to engage a resilient contact leaf, disposed on the frame and adjacent to the shaft and rotating components, causing separation of a contact point and terminal and thereby opening a supplemental circuit. In this way the rotary, push-pull headlight switch remains compact and externally uniform. The mounting of the supplemental switch internally and directly to the frame protects it and minimizes the risk of tolerance accumulation during fabrication. According further, the supplemental switch is used as a dome light bypass switch to open and close a dome light bypass circuit. Since the dome light bypass switch is mounted adjacent to the shaft and rotating components, rather than in line with them, there is sufficient space in the forward bracket area to allow for proper sizing of the components for use of the dome light bypass switch in the electrical current ranges desired.

The foregoing and other objects, features and advantages of the present invention will become more apparent in light of the following detailed description of exemplary embodiments thereof, as illustrated in the accompanying drawings.

BEST MODE FOR CARRYING OUT THE INVENTION

Figure 1:
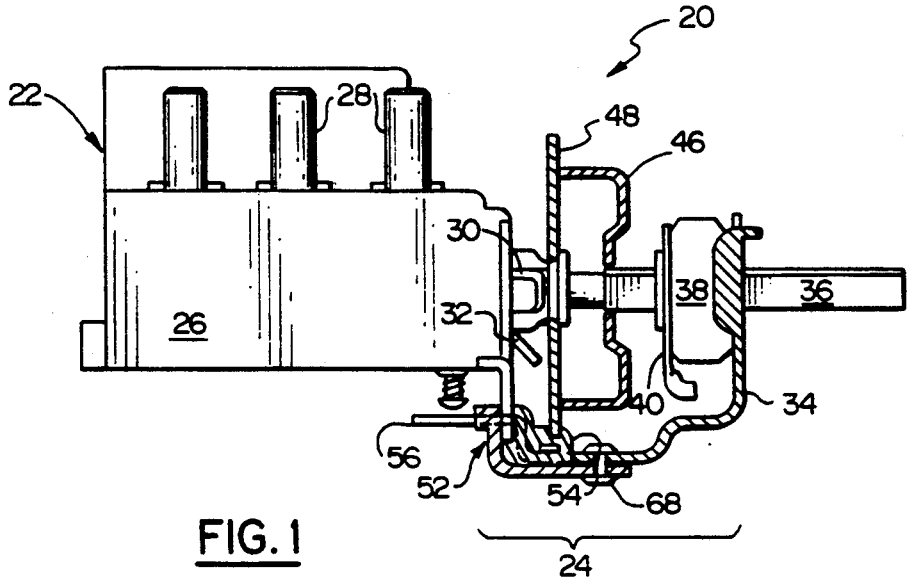
FIGS. 1 and 2 are partially sectioned side and top views, respectively, of a rotary, push-pull headlight switch.
Figure 2:
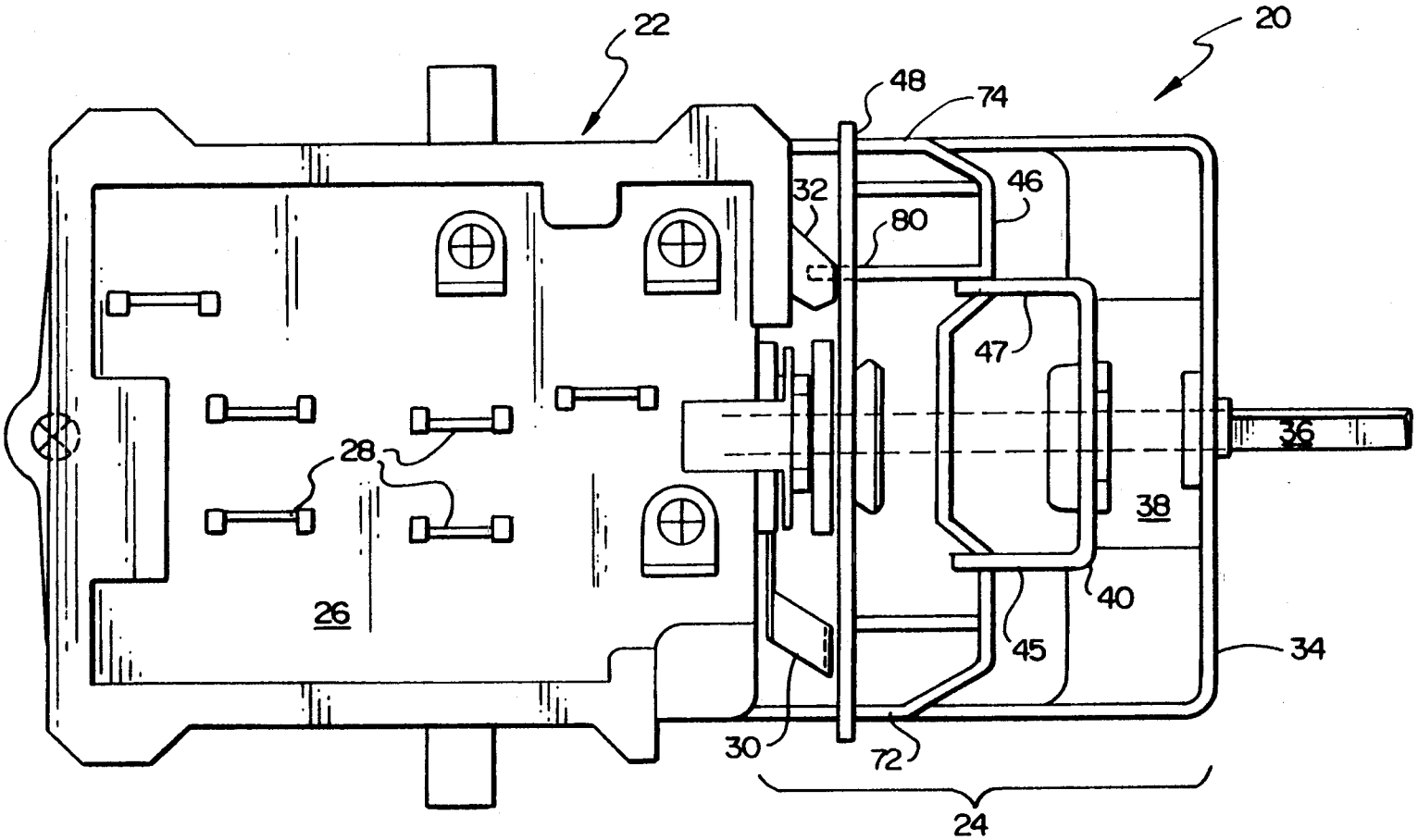

Referring now to FIGS. 1 and 2, a headlight switch assembly 20 consists of an electrical switch component 22, which is unchanged from prior art, and a front bracket assembly 24. The electrical switch component 22 consists of a switch body 26, internal circuitry (not shown), a plurality of terminal pins 28, an instrument light wiper 30 extending forward from the body 26, and a dome light on/off leaf 32 extending forward from the body 26.

The front bracket assembly 24 consists of a frame 34, designed to mount onto an automotive dashboard (not shown), a shaft 36 extending through the frame 34 and into the body 26 of the electrical switch component 22, a stationary spacer 38, a driver 40 which is slip fit on and engaged by the shaft 36, a rotary spacer 46 engaged by the driver 40, a rheostat 48 which is slip fit on the shaft 36 and engaged by the rotary spacer 46, and a dome light bypass switch assembly 52.

The shaft 36 is permitted both rotational motion about and axial movement along its longitudinal axis.

The rotational movement engages the components of the front bracket assembly 24 and the axial movement engages a headlight switch (not shown) located interval to the electrical switch component 22.

Figure 3:
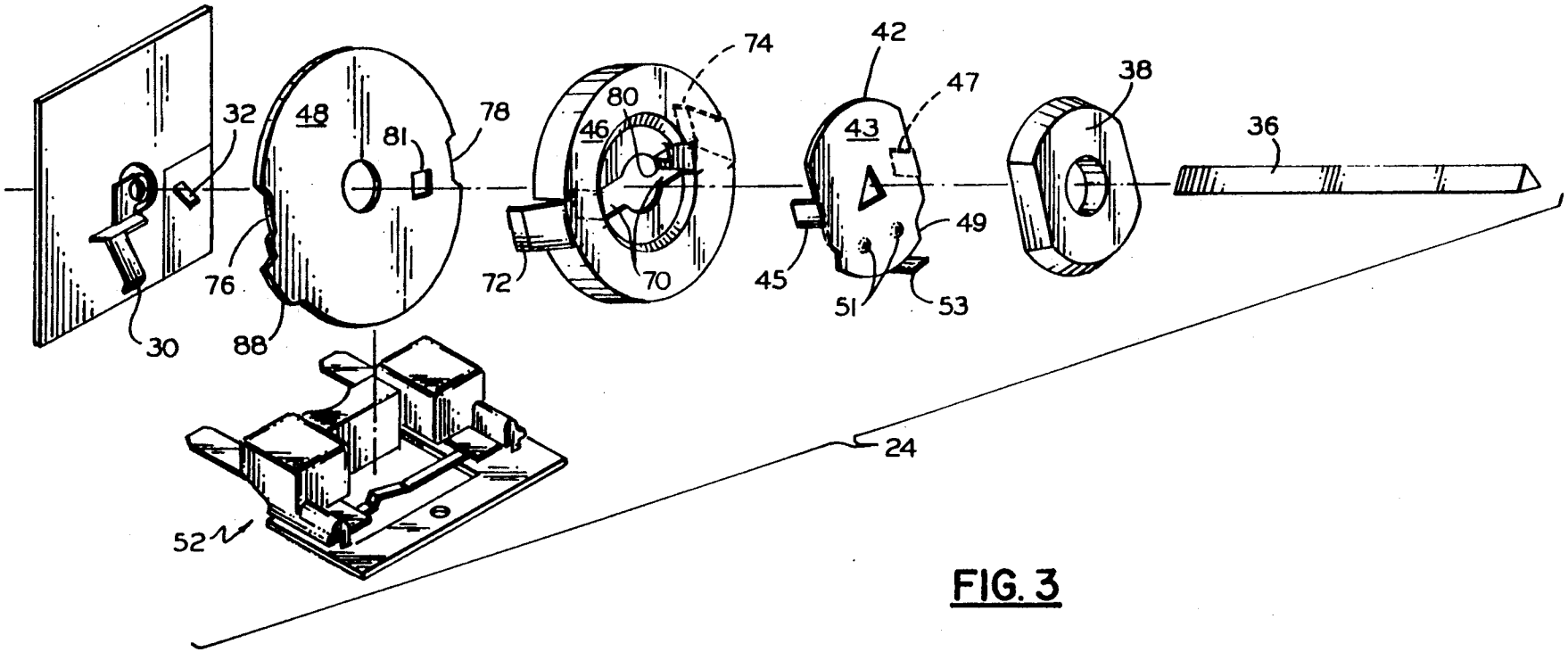
FIG. 3 is a front perspective exploded view of the forward components of a rotary push-pull headlight switch.

The interaction of the principal components of the front bracket assembly 24 is more clearly shown in FIG. 3. The driver 40 consists of a base plate 43, two back projections 45,47, and a wing 49 with a plurality of dimples 51 and a forward projection 53. The dimples 51 interact with the stationary spacer 38 to provide detent positions for the various rotational functions and the forward projection 53 engages the stationary spacer 38 to provide rotational stop positions for the headlight switch assembly 20. The back projections 45,47 engage the rotary spacer 46 through ends of a cut-out 70 in order to translate the rotational driving force from the shaft 36 to the rotary spacer 46. The rotary spacer 46 engages the rheostat 48 by two short protrusions 72, 74 which fit within cutouts 76, 78 around the edge of the rheostat 48 and by a long protrusion 80 on the rotary spacer 46 which extends through a hole 81 in the rheostat 48 and engages the dome light on/off leaf 32 upon sufficient rotation of the shaft 36. A cam 88 is disposed on the edge of the rheostat 48 and, upon sufficient rotation of the shaft 36, engages the dome light bypass switch assembly 52.

Figure 4:
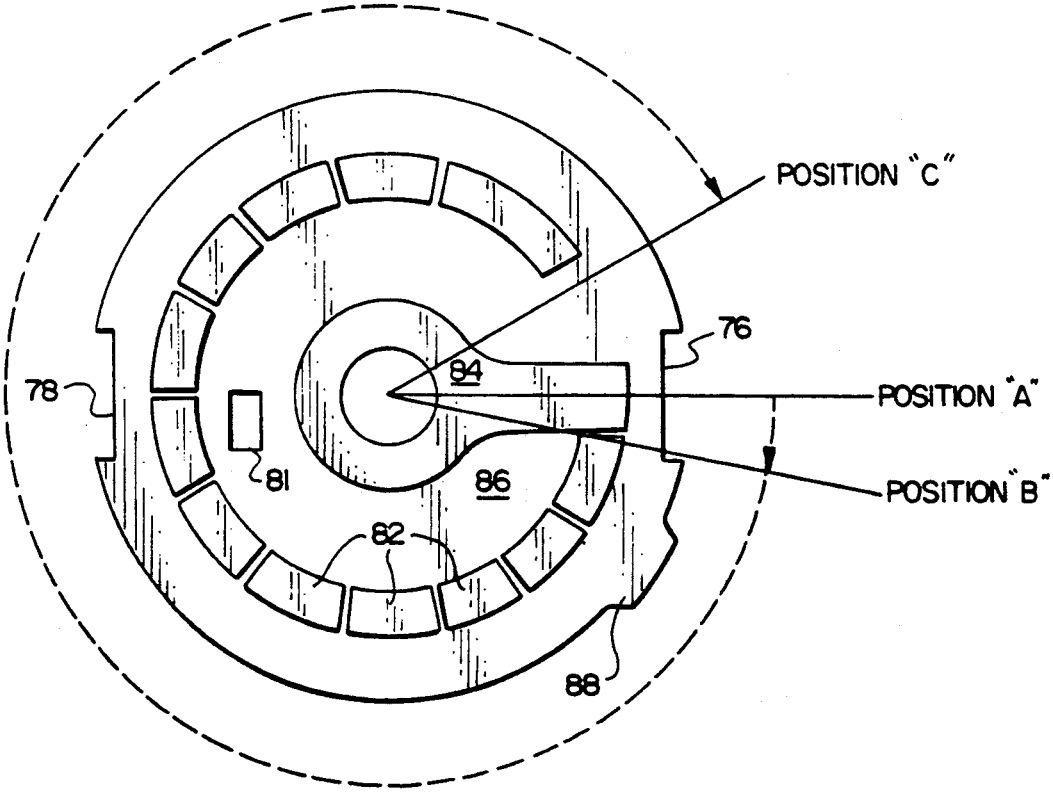
FIG. 4 is a rear view of a rheostat with switch positions superimposed upon it.

The rheostat 48, as viewed from the rear in FIG. 4, consists of a base plate 86 of electrically insulating material, a "zero resistance" pad 84 extending radially from the center of the rheostat 48, and a plurality of circularly disposed, peripherally spaced resistor surfaces 82. As the rheostat 48 is rotated, various surfaces make contact with the instrument light wiper 30 causing the intensity of the dashboard lights to vary. The various switch positions, as a function of rotation, are shown as viewed from the rear of the headlight switch assembly 20. In the full counterclockwise position (Position A), from the perspective of the user, the instrument light wiper 30 encounters the "zero resistance" pad 84 and the long protrusion 80 engages the dome light on/off leaf 32, thereby causing the dashboard light intensity to be maximum and the dome light to be energized. As the shaft 36 is rotated clockwise, the long protrusion 80 disengages from the dome light on/off leaf 32 (Position B), thereby causing the dome light to be de-energized, and the instrument light wiper 30 encounters increased resistance until the full clockwise position (Position C) when the instrument light wiper 30 encounters the insulating base plate 86 and the dashboard light circuit is opened.

Figure 5:
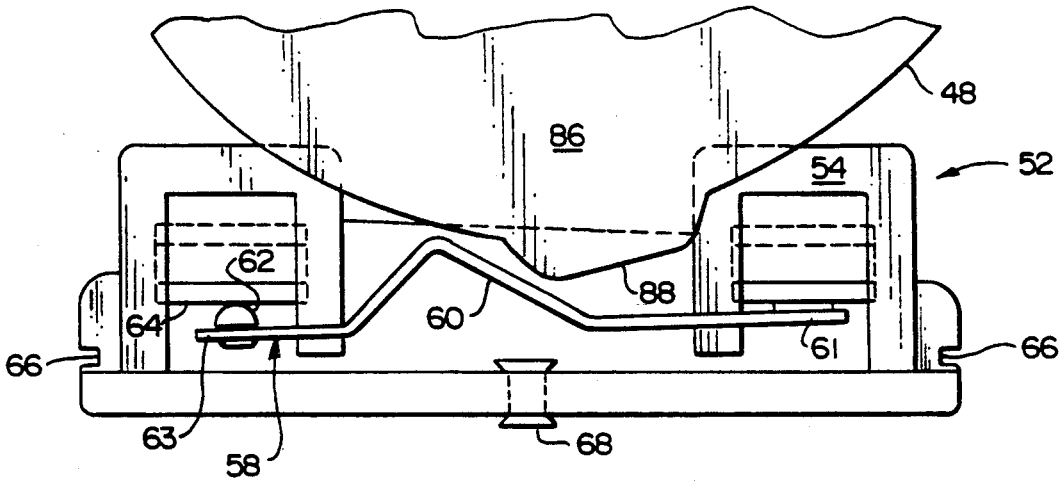
FIGS. 5, 6 and 7 are front, side and top views, respectively, of a dome light bypass switch.
Figure 6:
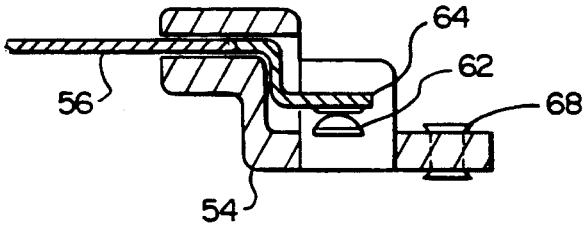
Figure 7:
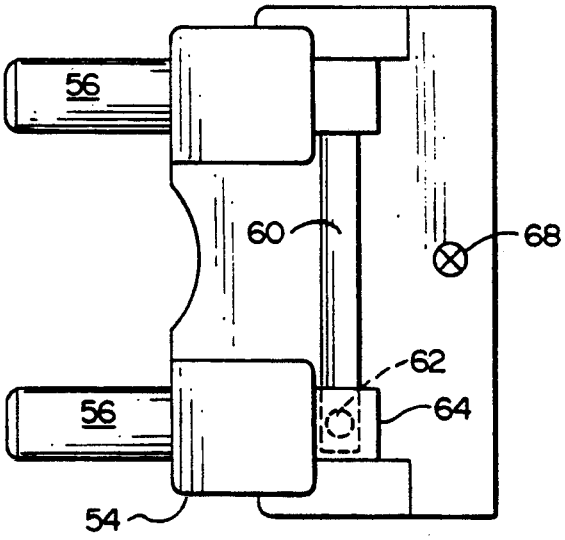

The dome light bypass switch assembly 52, shown in detail in FIGS. 5, 6, and 7, is disposed in a fixed relationship to the frame 34 directly beneath the rheostat 48 and consists of a terminal block 54, two terminal pins 56 press fit into the terminal block 54, and a contact assembly 58 which consists of a resilient contact leaf 60 with one end 61 rigidly disposed on the terminal block 54, a contact point 62 disposed on the other end 63 of the resilient contact leaf 60, and a terminal 64 disposed on the terminal block 54. The terminal block 54 is attached to the frame 34 by grooves 66 (FIG. 5) which allow the terminal block 54 to be positioned onto the frame 34 and a retaining mechanism 68, such as a rivet, which secures the terminal block 54 into position.

Referring to FIG. 5, a cam 88 on the base plate 86 of the rheostat 48 engages the resilient contact leaf 60 and causes separation of the contact point 62 and terminal 64 in the dome light bypass switch assembly 58 when the shaft 36 is completely rotated in the clockwise direction (Position C in FIG. 3). The separation of the contact point 62 and terminal 64 causes an opening of the dome light circuit and precludes the activation of the dome light. Rotation in the counter-clockwise direction disengages the cam 88 from the contact leaf 60 causing it to return to its initial position, the contact 62 and terminal 64 to reconnect, and the dome light may be energized.

Figure 8:
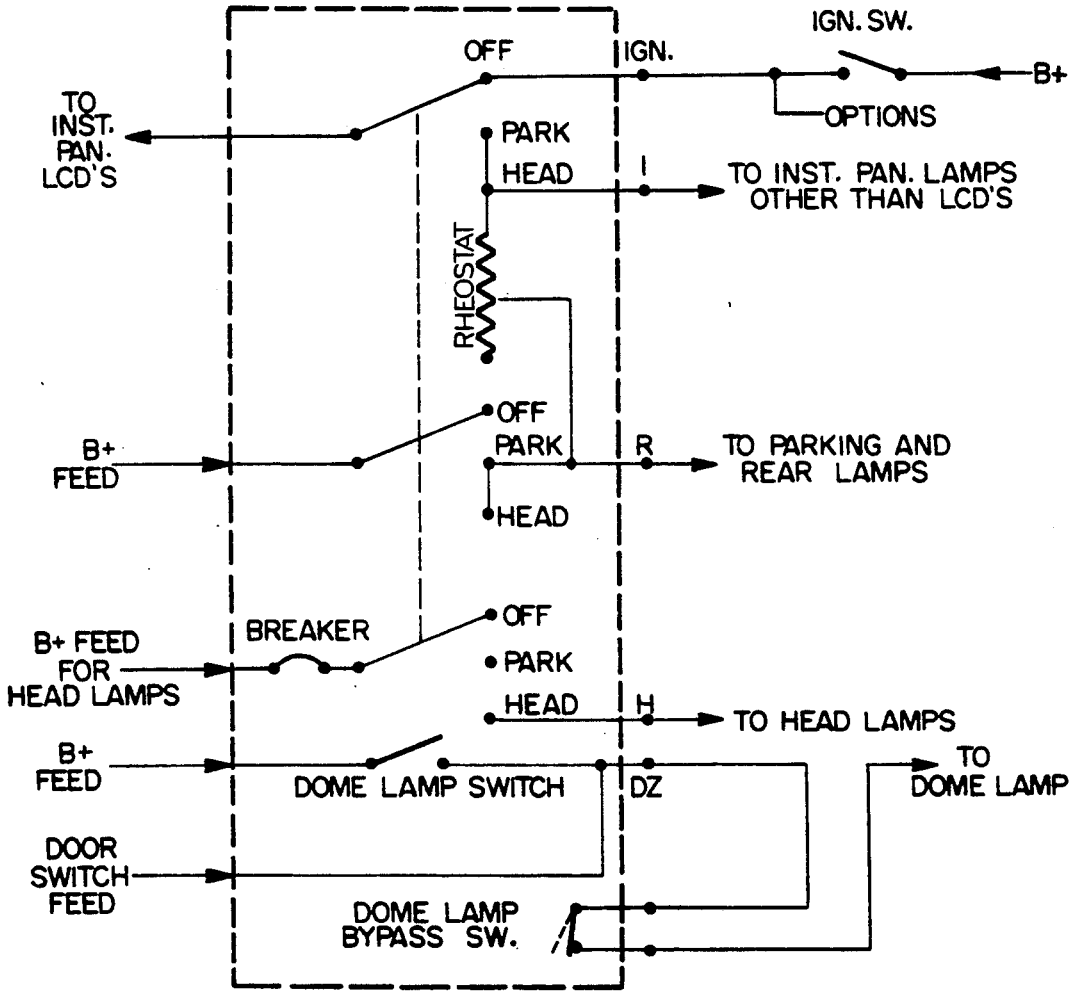
FIG. 8 is a general circuit diagram of a rotary, push-pull headlight switch system.

The opening and closing of the various circuits which control the headlights, dashboard lights, and dome light are shown generally in the switch circuit schematic of FIG. 8. The switches controlled by the push-pull action are indicated by a dashed line and the remaining switches are controlled by the rotational action.

The embodiment of the invention is illustrated in FIG. 1 as controlling the bypass function of the dome light circuitry. It should be understood that the present invention may be utilized to control other supplemental electrical circuits and components, as desired. Additionally, the system described utilizes a cam 88 projecting radially from the rheostat 48. In alternative embodiments of the invention a cam, or some other projection, may be disposed on another rotating component, as deemed appropriate.

Although the invention has been shown and described with respect to exemplary embodiments thereof, it should be understood by those skilled in the art that various changes, omissions and additions may be made therein and thereto, without departing from the spirit and scope of the invention.

We claim:

1. An improved rotary, push-pull switch having a frame, a rotatable, longitudinally extending shaft disposed on the frame and having axial positioning capabilities, an electrical switch component disposed on the frame and engaged with the shaft, said component having a longitudinally extending wiper and internal electrical circuitry including a primary electrical circuit and a supplemental electrical circuit, the primary electrical circuit opened and closed by axial movement of the shaft, and a plurality of longitudinally spaced rotating elements disposed on the shaft for common rotary movement, the rotating elements including a rheostat adapted to be actuated by rotation of the shaft such that the wiper circumferentially engages the rheostat, wherein the improvement comprises:

a projection disposed radially from and for common rotary movement with the shaft; and a supplemental switch, which is disposed within the frame, adjacent to the shaft and outward of the rotating elements, said supplemental switch adapted to open and close the supplemental electrical circuit, wherein said supplemental switch includes a terminal block, a pair of terminals disposed on said terminal block, and a resilient contact leaf having a first end electrically connected to one of said pair of terminals and a second end initially positioned to make electrical contact with the other of said pair of terminals, said contact leaf shaped to engage with said projection upon sufficient rotation of the shaft, whereby said engagement causes a separation of said second end and said other of said pair of terminals.

2. The rotary, push-pull switch according to claim 1, wherein said projection is disposed on and extends radially from the rheostat.

3. A rotary, push-pull switch for use in an automobile, said switch having a frame, a rotatable, longitudinally extending, shaft disposed on said frame and having axial positioning capabilities, an electrical switch component disposed on said frame and having a longitudinally extending wiper and internal electrical circuitry including a head lamp on/off circuit and a dome light circuit, the head lamp on/off circuit opened and closed by axial movement of the shaft, and a plurality of longitudinally spaced, rotating elements disposed on said shaft for common rotary movement, the rotating elements include a rheostat adapted to be actuated by rotation of the shaft such that the wiper circumferentially engages the rheostat, wherein the improvement comprises:

a projection disposed on and extending radially from the rheostat; and a dome light bypass switch, which is disposed within said frame, adjacent to said shaft and outward of the rotating elements within the frame, said dome light bypass switch adapted to open and closed the dome light circuit, wherein said dome light bypass switch includes a terminal block, a pair of terminals disposed on said terminal block, and a resilient contact leaf having a first end electrically connected to one of said pair of terminals with a second end initially positioned to make electrical contact with the other of said pair of terminals, and shaped to engage with said projection upon sufficient rotation of the shaft, whereby said engagement causes a separation of said second end and said other of said pair of terminals.

* * * * *